United States Patent [19]

Rolla

[11] 4,003,696

[45] Jan. 18, 1977

[54] FLAT SELF-SUPPORTING VAULT FOR TUNNEL TYPE FURNACES PARTICULARLY FOR BAKING BRICKS AND TILES

[76] Inventor: Aldo Rolla, Via S. Andrea 7, Monza, Italy

[22] Filed: July 7, 1975

[21] Appl. No.: 593,218

[30] Foreign Application Priority Data

July 12, 1974 Italy ..... 25114/74

[52] U.S. Cl. ..... 432/238; 432/251; 432/252; 110/1 A; 110/99 R

[51] Int. Cl.[2] ..... F27D 1/12

[58] Field of Search ..... 432/233, 173, 238, 237, 432/247, 252, 250, 251; 110/99 A, 99 R, 1 A; 266/32

[56] References Cited

UNITED STATES PATENTS

| | | | |
|---|---|---|---|
| 1,407,708 | 2/1922 | Thornton | 432/237 |
| 1,586,858 | 6/1926 | Strachota | 110/99 R |
| 1,819,016 | 8/1931 | Davey | 110/1 A |
| 2,186,740 | 1/1940 | Teeters | 432/238 |
| 2,217,384 | 10/1940 | Rodenbaugh | 432/252 |
| 3,284,979 | 11/1966 | Edwards | 110/99 A |
| 3,315,950 | 4/1967 | Potocnik et al. | 110/1 A |
| 3,812,798 | 5/1974 | Merkle, Jr. | 432/238 |

*Primary Examiner*—John J. Camby
*Assistant Examiner*—Henry C. Yuen

[57] ABSTRACT

A flat self-supporting vault for tunnel-type furnaces, particularly for baking bricks and tiles is made of mutually interconnected beams bearing at both ends on the side walls of the furnace disposed transversely to the tunnel length. Each beam is made of a number of longitudinally aligned refractory segments, also interconnected, preferably by expansion joints. Each segment is formed by casting around an inner longitudinal metal core at least long as a single beam. Each metal core, such as an I-beam of two C-beams, has an external sheath of thermo-insulating material and defines with this sheath a continuous linear passage for a cooling fluid flowing in a cooling system connected to both ends of each metal core.

6 Claims, 2 Drawing Figures

FLAT SELF-SUPPORTING VAULT FOR TUNNEL TYPE FURNACES PARTICULARLY FOR BAKING BRICKS AND TILES

BACKGROUND OF THE INVENTION

This invention relates to a flat vault for tunnel type furnaces, particularly to be used for baking bricks, tiles, ceramics, and the like, or in steel mills, and particularly to a self-supporting flat vault.

It is known that tunnel-type furnaces are built in the shape of a linear tunnel on the floor of which (if the material to be baked is carried on trucks) there may be laid a rail-track, for guiding the trucks carrying the material to be baked.

A major problem to be solved in the erection of said furnaces has been the design and construction of the vault.

Known types of vaults are usually built, by a static point of view, using the so-called flat arch structure the shape of which does not require any special anchoring means, and is self-supporting.

However, it has been observed that such a kind of vault negatively affects the performance of the furnace, in that there is left useless the whole room between the upper surface of the material, usually piled on the trucks in parallelepiped stacks and the inner side of the vault. It was impossible to use the free volume left, to increase the filling of material to be baked, said volume being on the contrary full of a mass of air to be heated. Moreover said type of vault imposes limitations on the useful width of the furnace.

No attention was even paid to the idea of stacking the material of the upper layers on the truck according to a profile complementary to that of the vault, in order to increase the filling coefficient of the furnace, in that the loading operations of the trucks would come out to be too difficult and time-consuming, and the material would afterwards have to be readjusted before packaging.

Flat vaults have then been built, so that the upper level of material on the trucks was slightly lower than the height of the tunnel. The furnace could then be filled as completely as possible. Heretofore, the erection of a flat vault has been performed by linear segments of refractory material, aligned on parallel rows, transversely to the direction of the forward movement of the material to be baked, said segments being clamped to each other by means of expansion joints each row being also connected to the adjacent ones by other expansion joints.

However this kind of structure is not self-supporting, whereby each row of segments of refractory material must be provided with an associated upper metal supporting bar, parallel to said segments, and the segments themselves hang from the bar being joined thereto by means of metal tie rods. The supporting bar is anchored in a way already known, per se, to the walls of the tunnel.

A vault so constructed, while overcoming the problem of a good filling coefficient of the furnace, is however affected by several disadvantages.

A first disadvantage is due to the exceedingly high weight of the vault, which bears on the side posts or masonry of the tunnel, said posts or masonry having to be sized accordingly, and moreover to the complex static system solving the problem of supporting the vault by external supporting bars.

Another disadvantage is due to the difficulties during erection of such a vault, in that it is necessary that each segment be clamped, one at a time, to the associated tie rod, which in turn is clamped to the supporting bar.

A further disadvantage is due to the very high cost of the vault, in that the metal frames involved in a so high proportion must be thermally stable, and therefore of good quality material, for example stainless steel, or thermostable cast iron. Moreover, the most critical limitation of a vault built accordingly is found in the connection zone between the metal frames and the refractory segments, which is subjected to very high temperatures.

It is known, on the other hand, that for this type of vault, a cooling system has to be provided, essential to remove heat from metal members in order to keep said members at a suitable temperature, according to their thermal resistance. Said system must be provided outside the vault and above the vault itself, in the positions where the metal tie rods and the supporting bars have been installed. That implies difficult heat removal conditions, because the cooling air is not in direct contact with the whole metal frame. On the contrary, the metal members located in those zones where the action of the cooling air has the least efficiency, are just the ones contacting the refractory material segments, said members being therefore subjected to the highest temperatures, i.e. to the most critical operating conditions, as aforesaid.

SUMMARY OF THE INVENTION

It is a general object of this invention to provide a flat vault for tunnel type furnaces, which overcomes the above disadvantages, being self-supporting, and accordingly not requiring either supporting bars or the associated tie rods. Therefore it is an object of this invention to provide a flat vault which has a structure simpler than the ones already known in the art, being moreover easier to be erected.

Another object of this invention is to provide a vault featuring a very low erection cost, and a substantial weight reduction, if compared with the conventional vaults.

A further object of this invention is to provide a vault which allows for designing a cooling system operable to act directly on the metal members, particularly the ones subjected to the highest temperatures, said system showing a high efficiency.

The vault for tunnel type furnaces, according to the invention, particularly for baking bricks and tiles, is characterized by including a number of self-supporting linear beams, laid transversely to the direction of forward movement of the material to be baked and bearing at both their ends on the side walls of said tunnel, each beam being comprised of a plurality of refractory material segments, clamped to each other by expansion joints, each beam including an inner metal core, at least a sheath of thermally insulating material being provided around said core, the inner metal core and said sheath defining, along the whole length of a beam, an empty volume, suitable as a passage for a cooling system.

BRIEF DESCRIPTION OF THE DRAWINGS

Further objects, advantages and features of the vault according to this invention, will become apparent, from the following detailed description of an embodiment thereof, shown by way of a non-limiting example only, with reference to the attached drawings, in which.

Figure 1:
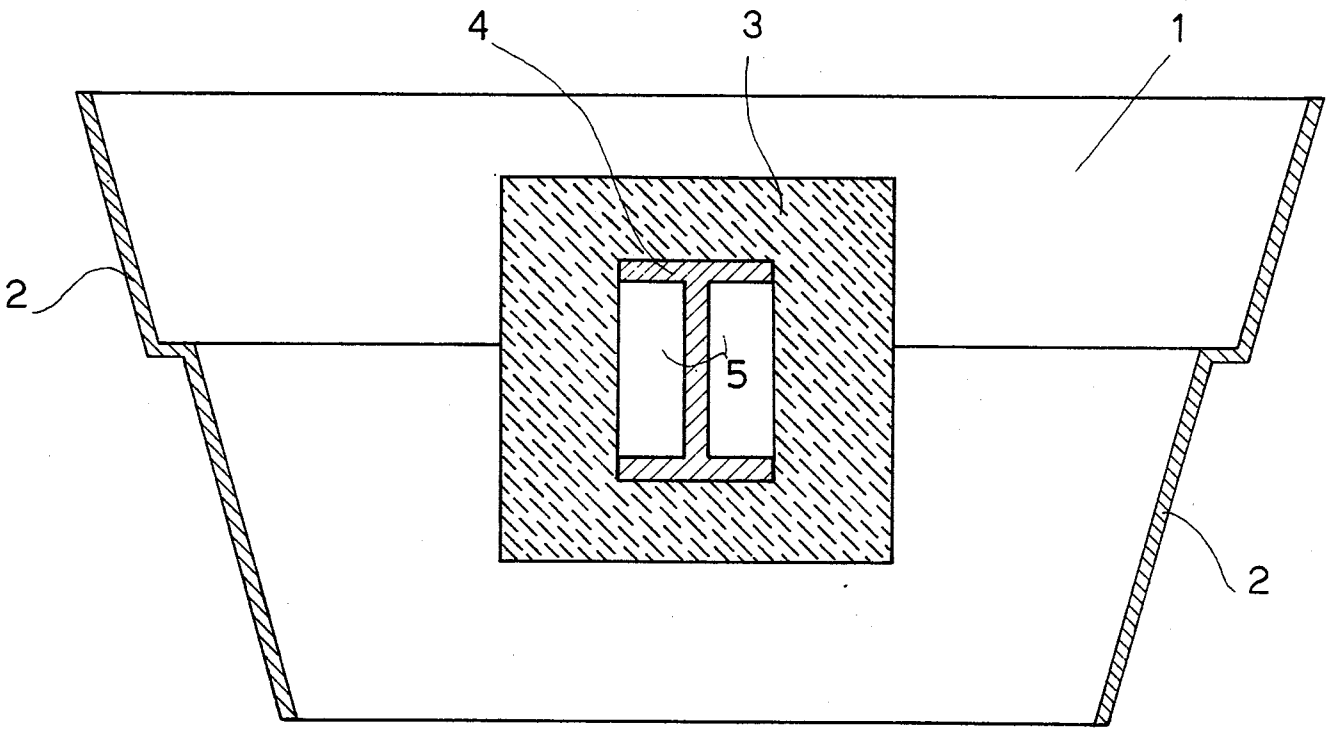
FIG. 1 is a cross-sectional view of a beam being an element of the vault according to this invention.

It should be noted that all the other beams not shown are similar to the ones shown in the drawings, and they may be provided in any given number, according to the length of the furnace. Moreover, the anchoring means between the vault and the side walls of the furnace (not shown) are neither described nor shown in this specification, being already known, per se, in the masonry technique.

DETAILED DESCRIPTION OF THE PREFERRED EMBODIMENT

Referring now to the drawings, each beam T is comprised of a number of segments 1 of refractory material, said segments being provided on their sides with usually known expansion joints 2, for clamping to the adjacent segments, belonging either to the same beam or to adjacent beams. Refractory material segments 1 may be of any suitable shape; the ones shown here are of a shape substantially similar to that of the conventional segments used for erecting the vaults already known. They have a substantially trapezoidal cross-section with the major base alternatively facing up or down; so that adjacent beams T have a complementary profile.

Each refractory segment 1 has a metal core 4, surrounded by a sheath 3 of a thermally insulating material, incorporated in the inner central part of said segment. The core section 4, which in the embodiment shown here is made of an I-beam forced inside a sheath 3, should be strong enough to render beams T self-supporting like the reinforcements of a reinforced concrete beam.

In the embodiment shown in the Figures, a single sheath 3 is illustrate, but it is obvious that two or more sheaths can be efficiently provided, according to the thermal insulation requirement related to the temperatures attained during operation of the furnace.

Metal core 4 has a length not less than that of beam T, because the ends of said core should rest or be anchored in any suitable way on the side walls of the furnace. Instead of the I-beam it is as well possible to use C-beams approaching each other by their longitudinal bent edges, or any other suitable metal section, according to the design requirements for supporting segments 1. The essential feature of metal core 4, for all the beams forming the vault, is in fact that of providing the beam with self-supporting characteristics, so that the vault consequently becomes self-supporting, and no further anchoring means is required.

Since all the segments of a single beam T are aligned, and since core 4 is linear, a linear passage 5, defined by thermally insulating sheath 3 and core 4, is then achieved inside each beam T. Said passage, according to the novel teachings of this invention, can be advantageously used to provide a portion of a cooling system, in order to bring cooling fluid in direct contact with the metal, so that an excessively high temperature increase can be avoided, which would otherwise be present at any rate, in spite of the presence of the thermally insulating sheath 3.

Figure 2:
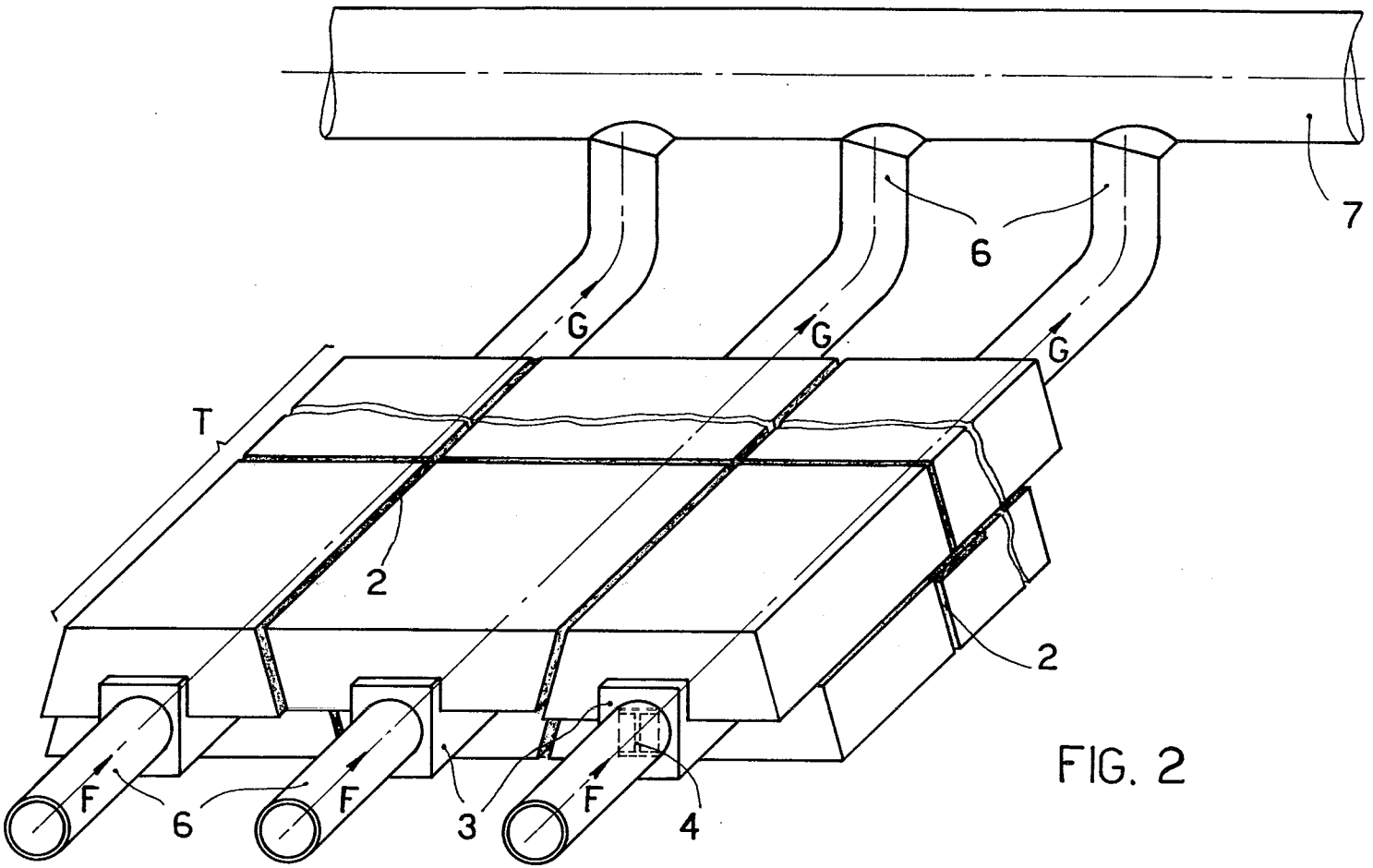
FIG. 2 is a perspective view of a length of the vault according to this invention.

If the temperatures are not too high, the cooling might be carried out by the action of the outer air only, by means of thermal convection and conduction, but according to this invention, it is easy to install a cooling system, as shown in FIG. 2. To that end, the passages 5 between core 4 and sheath 3, at either end of each beam T, are connected on one side to an air supply pipe 6, and on the other side to an air discharge pipe 6'. Air flows according to the direction of the arrows F and G, towards a discharge manifold 7, communicating in a known way to a coventional heat regeneration means (not shown).

As to the material employed, sheath 3 may be made for example of rock wool or kaolin wool, while metal core 4 may be stainless steel or merely iron, according to the operational conditions. Anyway, the choice of the properties of the refractory material and of the core metal is left to those skilled in the art, according to the operating temperatures normally encountered in the furnace and to the position of a given point along the longitudinal direction of said furnace, bearing in mind the particular temperature profile versus the distance from the furnace entrance, towards the outlet thereof.

The advantages provided by the flat vault according to this invention, are self-explaining. A first advantage is the possibility of doing away with large amounts of metal supporting frames, which are costly, either because of assembly problems, or because of the very high thermal properties involved. A further important advantage provided by this invention is the absence of any direct contact between metal members and refractory materials, so that said members are not subjected to any critical thermal stress condition during operation of the structure.

A further advantage resides in the provision for a complete thermal insulation of the metal members which on the other hand are reduced to a minimum, and in a direct cooling thereof in the zones where the temperatures would rise in spite of the presence of the thermal insulation. The cooling action becomes more efficient rendering as well more efficient the regeneration of the extracted heat.

The present structure is substantially lighter and less expensive than any conventional structure, and allows for higher furnace operating temperatures, which improve accordingly the performance of the furnace.

It should finally be noted how fast can be the erection of a vault as hereinbefore described, all the various segments 1 of a beam being prepared in a single casting or ramming operation, around each core 4, and sheath 3.

Those skilled in the art will possibly be able to make additions and/or modifications to the embodiment of the flat vault for tunnel-type furnaces hereinbefore described and shown, according to this invention, without exceeding the scope thereof.

What I claim is:

1. A flat vault for tunnel-type furnaces for baking materials having parallel extended side walls, comprising a plurality of linear self-supporting beams laid transversely to the direction of forward movement of the material to be baked and bearing at their respective ends on the side walls of said tunnel, each beam being fixed to the adjacent beams and comprising a plurality of segments of a refractory material, clamped to each other by means of expansion joints, and each segment being provided with an inner metal core and an insulating material sheath surrounding said core, whereby said core and inner surfaces of said sheath define, along the whole length of each of said segments, a free volume suitable to provide a passage for a cooling fluid, flowing by means of a cooling system.

2. The vault as claimed in claim 1, wherein each free volume is connected at either of its ends to a supply pipe and to a discharge pipe respectively, for the flow of the cooling fluid of said cooling system.

3. The vault as claimed in claim 1, wherein the length of said metal core is at least as long as that of the beam, each beam resting at both ends on the side walls of the tunnel-type furnace by means of the metal cores and sheaths.

4. The vault as claimed in claim 1, wherein said core comprises a section iron being so dimensioned to render said beam self-supporting, surrounded by said sheath and embedded in its segment.

5. The vault as claimed in claim 1, wherein each segment has a trapezoidal cross-section.

6. The vault as claimed in claim 5, wherein the segments of a first beam have the major base of their cross-section facing upwards and those of the adjacent beams have the major base of their cross-section facing downwards.

* * * * *